United States Patent [19]

Kim

[11] 4,419,555

[45] Dec. 6, 1983

[54] ILLUMINATED PUSH-BUTTON SWITCH ASSEMBLY

[75] Inventor: Syng N. Kim, Hoffman Estates, Ill.

[73] Assignee: Wilco Corporation, Niles, Ill.

[21] Appl. No.: 383,811

[22] Filed: Jun. 1, 1982

[51] Int. Cl.[3] ..... H01H 3/12; H01H 9/02

[52] U.S. Cl. ..... 200/314; 200/159 A; 200/153 LA; 200/293; 200/340

[58] Field of Search ..... 200/153 LA, 159 R, 159 A, 200/283, 293, 296, 307, 310, 313, 314, 340, 295

[56] References Cited

U.S. PATENT DOCUMENTS

| | | | |
|---|---|---|---|
| 2,610,237 | 9/1952 | Benner . | |
| 2,780,801 | 12/1953 | Tyler . | |
| 2,847,559 | 8/1958 | Harrington et al. . | |
| 2,924,692 | 4/1957 | Camp et al. . | |
| 3,141,945 | 7/1964 | Juggins | 200/159 R |
| 3,170,057 | 2/1965 | Kane et al. . | |
| 3,317,695 | 5/1967 | Dennison . | |
| 3,367,206 | 2/1968 | Moody | 200/340 X |
| 3,437,775 | 4/1969 | Piber | 200/314 |
| 3,522,403 | 10/1968 | Fuller . | |
| 3,601,567 | 8/1971 | Shah | 200/314 |
| 3,626,133 | 12/1971 | Teruzzi | 200/295 |
| 3,676,630 | 7/1972 | Dennison | 200/295 |
| 3,832,506 | 8/1974 | Dewhurst | 200/314 |
| 3,989,912 | 11/1976 | Francke | 200/314 X |
| 4,004,120 | 1/1977 | Lee | 200/310 |
| 4,064,381 | 12/1977 | Mullen et al. | 200/307 |
| 4,080,523 | 3/1978 | de Loisy | 200/314 |

FOREIGN PATENT DOCUMENTS

| | | | |
|---|---|---|---|
| 1145689 | 8/1961 | Fed. Rep. of Germany | 200/159 A |
| 2389214 | 12/1978 | France | 200/295 |
| 958663 | 5/1964 | United Kingdom | 200/314 |

*Primary Examiner*—James E. Bryant, III
*Assistant Examiner*—Ernest G. Cusick
*Attorney, Agent, or Firm*—Dithmar, Stotland, Stratman & Levy

[57] ABSTRACT

An illuminated push-button switch assembly includes a tubular housing closed at one end thereof by a base member having a lamp receptacle disposed within the housing and switch-mounting arms disposed externally of the housing. A leaf switch is mounted between the switch mounting arms and the leaf contacts thereof extend through an opening in the base member into the housing alongside the lamp. A cup-shaped actuator is disposed for longitudinal movement within the housing and has a pair of legs respectively extending through complementary openings in the base member and respectively surrounded by helical compression springs for resiliently biasing the actuator to a normal rest position. The actuator has a light-transmitting cover which covers the other end of the housing. A cam surface on the actuator cam-actuates the switch contacts upon depression of the actuator button.

10 Claims, 6 Drawing Figures

FIG. 1
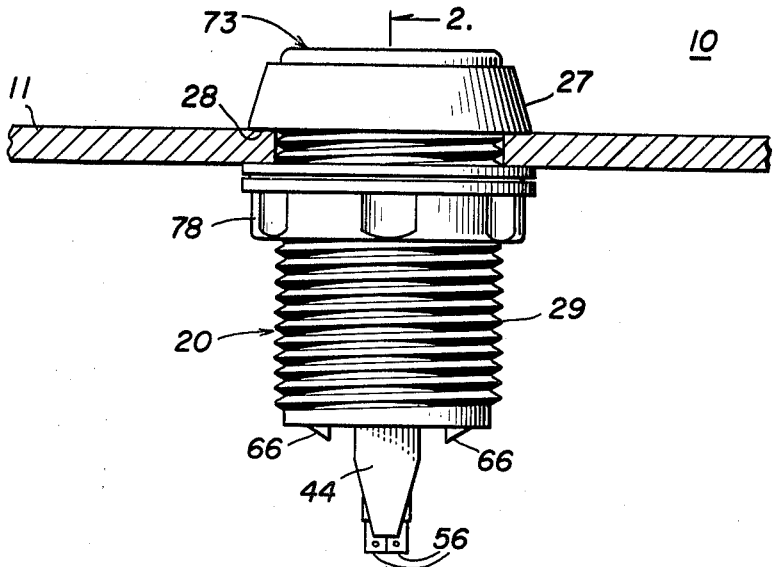
FIG. 2
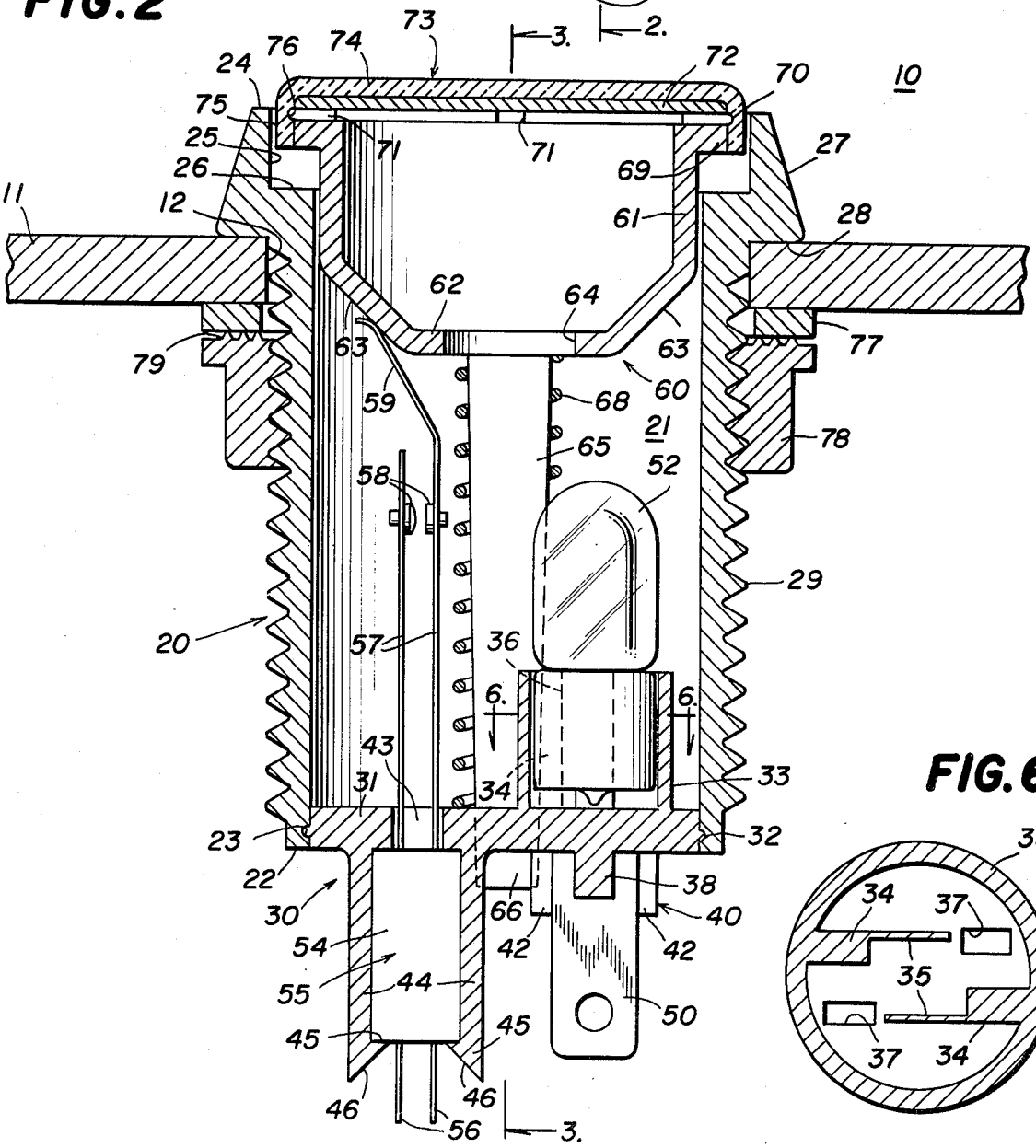
FIG. 6

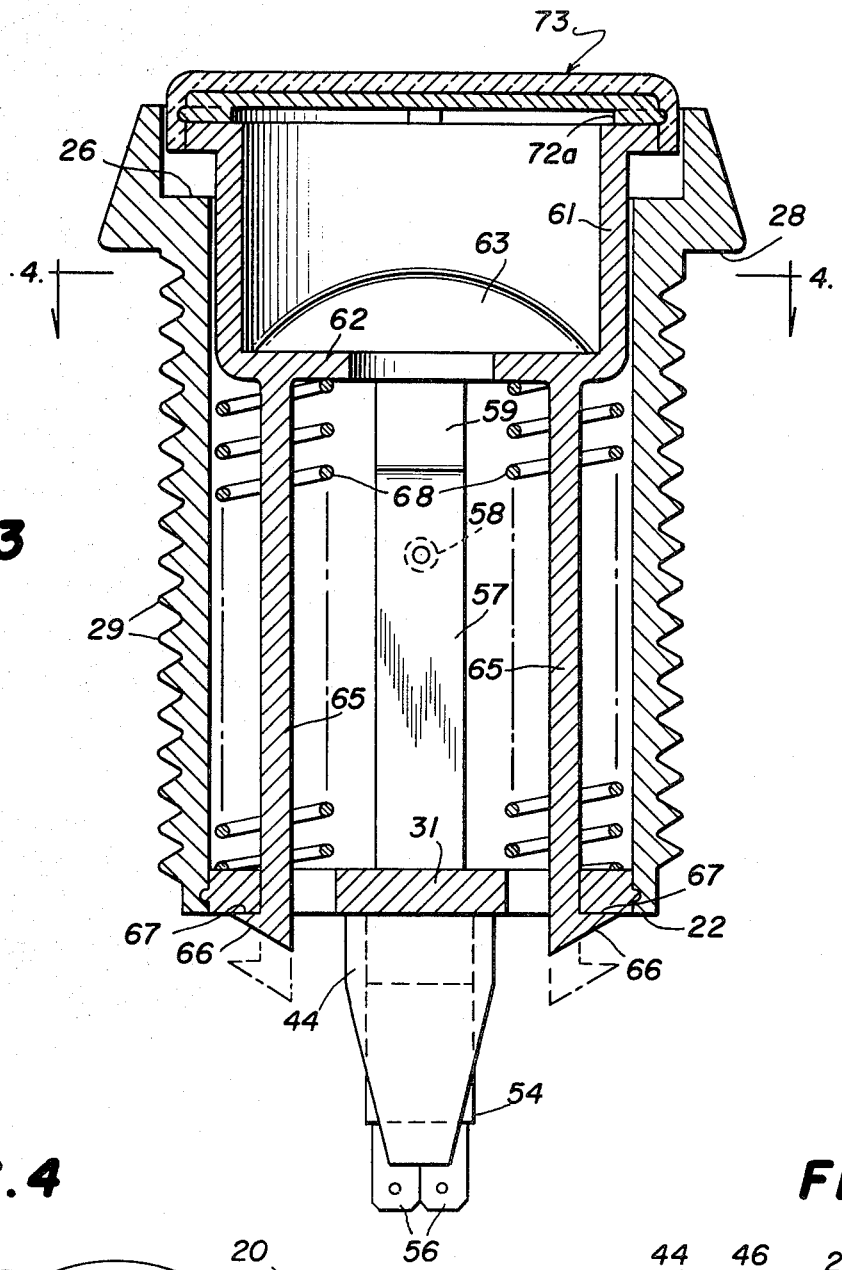
FIG. 3
FIG. 4
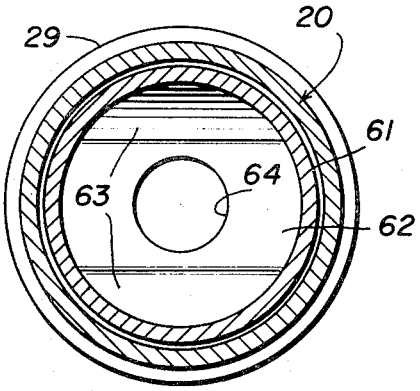
FIG. 5
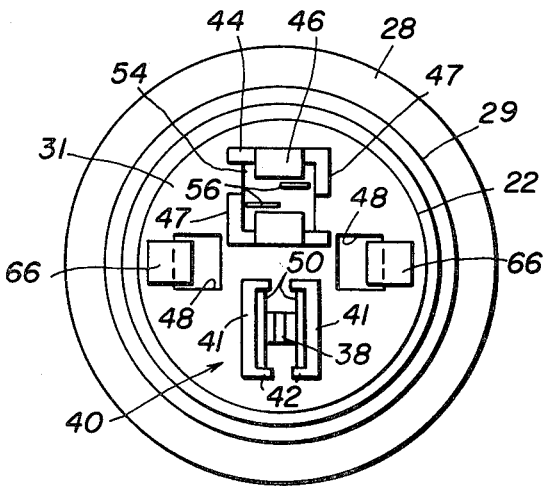

ILLUMINATED PUSH-BUTTON SWITCH ASSEMBLY

BACKGROUND OF THE INVENTION

The present invention relates to illuminated push-button switches such as those used on electronic devices such as electronic games and the like. Such switches have a push-button actuator and illumination means for continuously illuminating the push button and/or providing an indication when the switch is actuated.

Many types of illuminated push-button switch assemblies are known, but most are of relatively complex multi-part construction, and many such switch assemblies are characterized by movement of the illumination lamp along with the push-button actuator, which subjects the lamp to considerable wear and vibration and results in loose contacts and/or early failure of the lamp. A more modern switch assembly, made by Starpoint Electrics Limited in England, is characterized by relatively simple construction embodying relatively few parts, but that device utilizes a microswitch, which is a fairly expensive component.

SUMMARY OF THE INVENTION

The present invention relates to an improved illuminated push-button switch assembly which avoids the disadvantages of prior devices while affording additional structural and operating advantages.

A general object of this invention is to provide an improved illuminated push-button switch assembly which is of simple and economical construction, being characterized by a minimum number of parts.

In connection with the foregoing object, it is another object of this invention to provide an illuminated push-button switch assembly of the type set forth which can easily be assembled without the use of tools and which utilizes an inexpensive electric switch.

Still another object of this invention is the provision of an illuminated push-button switch assembly of the type set forth, which is characterized by a stationary electric lamp and switch, wherein the lamp and the switch contacts are both disposed within a protective housing.

These and other objects of the invention are attained by providing an illuminated push-button switch assembly comprising: a tubular housing, a base member closing the housing at one end thereof, electric lamp means carried by the base and disposed within the housing, electric switch means carried by the base and having switch contacts disposed within the housing, an actuator disposed for reciprocating movement within the housing longitudinally thereof between a normal rest position and an actuating position, the actuator having a light-transmitting portion closing the housing at the other end thereof, the actuator having a cam surface disposed within the housing for engagement with and closure of the switch contacts in response to movement of the actuator from the rest position to the actuating position thereof, and bias means resiliently urging the actuator to the normal rest position thereof.

The invention consists of these and other novel features and a combination of parts hereinafter fully described, illustrated in the accompanying drawings and particularly pointed out in the appended claims, it being understood that various changes in the details may be made without departing from the spirit or sacrificing any of the advantages of the invention.

BRIEF DESCRIPTION OF THE DRAWINGS

FIG. 1 is a side elevational view of an illuminated push-button switch assembly constructed in accordance with and embodying the features of the present invention, shown mounted on a fragmentary portion of an associated mounting panel;

FIG. 2 is an enlarged view in vertical section taken along the line 2—2 in FIG. 1;

FIG. 3 is a view in vertical section taken along line 3—3 in FIG. 2;

FIG. 4 is a reduced view in horizontal section taken along line 4—4 in FIG. 3;

FIG. 5 is a bottom plan view of the switch assembly illustrated in FIG. 3; and FIG. 6 is a view in horizontal section taken along the line 6—6 in FIG. 2.

DESCRIPTION OF THE PREFERRED EMBODIMENT

Referring now to FIGS. 1 and 2 of the drawings, there is illustrated an illuminated push-button switch assembly, generally designated by the numeral 10, constructed in accordance with and embodying the features of the present invention. The switch assembly 10 is illustrated in its mounted position in a circular aperature 12 in a mounting panel 11, which may, for example, be a panel of an electronic game or the like.

The switch assembly 10 includes an elongated, tubular housing, generally designated by the numeral 20, which has a smooth cylindrical inner surface 21 terminating in an annular end surface 22. Formed in the inner surface 21 closely adjacent to the end surface 22 is an annular groove 23 substantially semi-circular in transverse cross section. The other end of the housing 20 has a flat, annular end surface 24, and formed therein is a cylindrical recess 25 terminating in an annular shoulder 26. This end of the housing 20 is thick and is provided with a frustoconical outer surface 27 which slopes radially outwardly away from the end surface 24 and terminates in an annular support surface 28 which is disposed in a plane substantially perpendicular to the axis of the housing 20. The outer surface of the housing 20 is threaded, as at 29, from the support surface 28 to the end surface 22.

Referring also to FIGS. 3, 5 and 6 of the drawings, the switch assembly 10 also includes a base member, generally designated by the numeral 30, which is of unitary one-piece construction, preferably being molded of a suitable plastic. The base member 30 has a substantially circular, disc-like base plate 31 provided around the outer edge thereof with a circumferential rib 32. Integral with the base plate 31 and projecting upwardly therefrom eccentrically thereof is a circular cylindrical lamp socket 33. Integral with the inner surface of the socket 33 are two substantially parallel, spaced-apart retainer walls 34, each having a recessed or reduced-thickness portion 35 adjacent to the distal end thereof, each of the retainer walls 34 terminating a predetermined distance from the side of the cylindrical socket 33. Each of the retainer walls 34 has a downwardly inclined beveled surface 36 at the upper end thereof.

Formed in the base plate 31, respectively adjacent to the distal edges of the retainer walls 34, are two generally rectangular openings 37. Integral with the base plate 31 and projecting downwardly therefrom in the opposite direction from the socket 33, substantially coaxially therewith and between the openings 37 is a spacer post 38. Also integral with the base plate 31 and respectively spaced from the spacer post 38 on opposite sides thereof are two retainer channels 40, each having a main wall 41 and two end flanges 42, the main walls 41 of the retainer channels 40 being substantially parallel, and the end flanges 42 of one retainer channel being respectively substantially coplanar with the end flanges 42 of the other retainer channel 40.

Also formed through the base plate 31 alongside the lamp socket 33 is an opening 43. Integral with the base plate 31 and projecting therefrom in the same direction as the retainer channels 40 on opposite sides of the opening 43 are two substantially parallel, elongated, flexible support legs 44 (see FIGS. 2 and 5), each provided adjacent to the distal end thereof with an inwardly projecting tab 45, provided with an inwardly inclined cam surface 46. Each of the support legs 44 has integral therewith along one side edge thereof a short retaining flange 47 which projects toward the other one of the support legs 44. Also formed through the circular base plate 31 are two spaced-apart, substantially rectangular holes 48, which are disposed along a common diameter of the base plate 31 substantially at right angles to the diameter along which the opening 43 and lamp socket 33 lie.

A pair of conductive terminals 50 are respectively frictionally seated in the spaces between the spacer post 38 and the retainer channels 40, each of the terminals 50 having a contact portion which projects upwardly through the associated one of the openings 37 and into the socket 33, respectively alongside the distal edges of the retainer walls 34. A lamp bulb 52 is frictionally seated between the retainer walls 34, with the terminals thereof respectively in engagement with the contact portions of the terminals 50. The bulb 52 is removably mounted in the socket 33, and it will be appreciated that the beveled surfaces 36 on the retainer walls 34 serve to facilitate insertion of the bulb 52 into the socket 33.

Mounted between the support legs 44 is the body 54 of an electric switch 55. Preferably, the switch 55 is a leaf switch having two terminals 56 which project from one end of the body 54 and two elongated flexible resilient spring leafs 57 which project from the other end of the switch body 54 upwardly through the opening 43 and along side the socket 33. The leafs 57 are respectively provided with contact buttons 58 adapted for contact with each other. One of the leafs 57 has an angled actuator extension 59.

In assembly, the switch body 54 is pushed up between the support legs 44 from the distal ends thereof, with the leafs 57 projecting up through the opening 43. More particularly, the switch body 54 engages the cam surfaces 46 and resiliently spreads apart the support legs 44 to permit passage of the switch body 54 therebetween. When the outer end of the switch body 54 passes the tabs 45, the support legs 44 spring back to their normal position, with the tabs 45 engaging the outer end of the switch body 54, securely to hold it in place between the support legs 44 and against the outer surface of the base plate 31, as illustrated in FIG. 2. When the terminals 50, the lamp 52 and the switch 55 have all been thus assembled on the base member 30, the base member 30 is inserted in the lower end of the housing 20, with the circumferential rib 32 snap-fitting into the annular groove 23, securely to hold the base member 30 in place. When the base member 30 is thus assembled, the circular base plate 31 serves to close the adjacent end of the housing 20, and the actuator extension 59 of the switch 55 projects well into the housing 20, to a point adjacent to the other end thereof. It will be appreciated that the parts are somewhat flexible and that by wiggling of the base member 30 it can be disassembled from the housing 20 for replacement of the bulb 52, for example.

Referring now also to FIG. 4 of the drawings, the switch assembly 10 also includes an actuator member, generally designated by numeral 60 (see FIG. 2), which includes a generally cylindrical hollow body 61 closed at one end thereof by a bottom wall 62 and provided with sloping cam walls 63. The bottom wall 62 has a circular aperture 64 therethrough centrally thereof. The cylindrical body 61 is dimensioned to fit inside the tubular housing 20 for reciprocating movement therein longitudinally thereof. Integral with the bottom wall 62 and projecting outwardly thereof on opposite sides of the circular aperture 64 are two elongated, tapered legs 65, each generally rectangular in transverse cross section, the legs 65 being flexible and resilient and diverging slightly toward the distal ends thereof. Each of the legs 65 is provided at the distal end thereof with a cam surface 66 sloping laterally outwardly and toward the other end of the legs 65. Each leg 65 also has a retaining shoulder 67 along the outer surface thereof adjacent to the distal end thereof. Respectively disposed in surrounding relationship with the legs 65 are two helical compression springs 68.

The open end of the cylindrical body 61 is provided with a radially outward extending annular flange 69, the upper surface of which has equiangularly spaced-apart, radially extending notches or grooves 71 therein. Integral with the annular flange 69 and projecting radially outwardly therefrom is a circumferential rib 70 which is substantially semi-circular in transverse cross section. A circular indicia plate 72, formed of light-transmitting material, overlies the annular flange 69, the plate 72 being imprinted with any desired indicia. The indicia plate 72 is secured in place by a cover 73 formed of light-transmitting material, the cover 73 having a circular top wall 74 overlying the indicia plate 72 and a peripheral cylindrical flange 75 extending downwardly around the annular flange 69 in surrounding relationship therewith. The flange 75 has a circumferential groove 76 on the inner surface thereof adapted to be snap-fitted into engagement with the circumferential rib 70 on the annular flange 69, securely to hold the cover 73 in place, the outer diameter of the flange 75 being slightly less than the diameter of the annular recess 25 in the housing 20. One or more projections **72*a* (FIG. 3) may be provided on the bottom surface of the indicia plate 72 for engagement in the notches 71 of the annular flange 69 for preventing rotation of the indicia plate 72 with respect to the actuator member 60**.

In assembly, the indicia plate 72 and the cover 73 are first mounted on the actuator member 60 and the legs 65, with the springs 68 disposed therearound, are inserted into the open recessed end of the housing 20 and respectively through the holes 48 in the base plate 31. In this regard, the cam surfaces 66 respectively engage the outer edges of the holes 48 for deflecting the legs 65 toward each other to permit passage of the distal ends thereof through the holes 48, until the retaining shoulders 67 clear the outer ends of the holes 48, at which point the legs 65 spring back to their normal spacing, with the retaining shoulders 67 disposed for engagement with the outer surface of the base plate 31, as illustrated in FIG. 3. The compression springs 68 bear against the inner surface of the base plate 31 and the bottom wall 62 of the actuator member 60, resiliently to urge the actuator member 60 to a normal rest position, illustrated in solid line in the drawings, wherein the retaining shoulders 67 are in engagement with the base plate 31 and the push-button cover 73 projects a slight distance outwardly beyond the end wall 24 of the housing 20.

In operation, when the push-button cover 73 is pushed by a user, the actuator member 60 is depressed within the tubular housing 20, against the urging of the compression springs 68, to an actuated position illustrated in broken line in FIG. 3, the annular flange 69 engaging the shoulder 26 of the housing 20 to stop the movement of the actuator member 60 in this actuating position. When the switch assembly 10 is disposed in its normal rest position, illustrated in solid line in the drawings, the actuator extension 59 of the switch 55 is disposed in engagement with the outer surface of one of the cam walls 63 of the actuator member 60 (see FIG. 2), with the contact buttons 58 of the leafs 57 being spaced apart. As the actuator member 60 is depressed to its actuating position, the actuator extension 59 is cammed radially outwardly to bring the contact buttons 58 into engagement with each other to close the switch 55.

The lamp 52 may be connected to an associated source of electric power through the switch 55, so that closure of the switch contacts will energize the lamp 52. The aperture 64 in the bottom wall 62 of the actuator member 60 permits the light from the lamp 52 to pass directly to the light-transmitting indicia plate 72 and push button cover 73 for illuminating same. When the push-botton cover 73 is released, the actuator member 60 returns to its normal rest position under the urging of the compression springs 68, reopening the contacts of the switch 55 and deenergizing the lamp 52. Alternatively, the lamp 52 may be permanently connected to a source of electric power independently of the switch 55 for providing a constant illumination of the switch asembly 10.

In mounting the switch assembly 10 on the associated mounting panel 11, the threaded end of the housing 20 is inserted through the aperture 12 until the annular support surface 28 engages the outer surface of the mounting panel 11. A washer 77 is then slipped over the threaded end of the housing 20 and a nut 78 is threaded into engagement therewith, the nut 78 having a serrated or ribbed gripping surface 79, which bears against the washer 77 firmly to hold it against the inner surface of the mounting panel 11, all in a well known manner.

It is a significant aspect of the present invention that the housing 20, the base member 30, the actuator member 60, the indicia plate 72 and the push buttom cover 73 may all be formed of molded plastic and can be assembled together without the use of tools. Another aspect of the invention is that the parts preferably have sufficient flexibility that they can be manually disassembled. Thus, the base member 30, with the bulb 52 and the switch 55 mounted thereon, can be removed as a unit for replacement of the bulb 52 and/or service of the switch 55. Another important aspect of the invention is that it provides a simple and positive switch action, while utilizing a very inexpensive type of electric switch, and provides a construction wherein the lamp bulb 52 and the switch contacts are confined within the protective tubular housing 20.

From the foregoing, it can be seen that there has been provided an improved push-button switch assembly, which is simply and economically formed of a minimal number of parts, capable of assembly and disassembly without the use of tools, and utilizing an inexpensive leaf switch while housing the leaf switch contacts and the lamp bulb in an enclosed protective housing.

What is claimed is:

1. An illuminated push-button switch assembly comprising: a hollow cylindrical housing, a base member closing said housing at one end thereof and having a first aperture and a pair of spaced apertures therethrough, electric switch means carried by said base member outside said housing and having switch contacts extending through said first aperture into said housing, an actuator disposed for reciprocating movement within said housing longitudinally thereof between a normal rest position and an actuating position, said actuator having a light-transmitting portion closing said housing at the other end thereof, said actuator having a cam surface disposed within said housing for engagement with and closure of said switch contacts in response to movement of said actuator from the rest position to the actuating position thereof, said actuator including a pair of resilient legs extending longitudinally of said housing and provided with cam means at the distal end thereof, said cam means being engageable with the outer edges of said a pair of spaced apart second apertures for cammed deflection to permit insertion thereof through said pair of spaced apart second apertures, said pair of resilient legs having retaining means adjacent to the distal end thereof, said pair of resilient legs resiliently returning to their original position after insertion through said pair of spaced apart second apertures for bringing said retaining means into position for engagement with the outer surface of said base member when said actuator is disposed in its normal rest position, lamp receptacle means formed integrally with said base member and projecting therefrom into said housing externally of said actuator, electric lamp means carried by said base member in said receptacle means, and bias means resiliently urging said actuator to the normal rest position thereof.

2. The switch assembly of claim 1, wherein said switch means comprises a leaf spring switch.

3. The switch assembly of claim 2, wherein said switch contacts are adapted for movement into and out of engagement with each other substantially laterally of said housing.

4. The actuator assembly of claim 1, and further including means providing snap-engagement of said base with said housing for removably mounting said base member in said one end of said housing.

5. The switch assembly of claim 1, wherein said base members is of unitary one-piece construction, and further including snap-engageable means for removably mounting said base member in said one end of said housing.

6. The switch assembly of claim 1, wherein said switch contacts and said electric lamp means are disposed substantially side by side in said housing.

7. The switch assembly of claim 1, wherein said housing has a longitudinal axis, said lamp means being disposed non-coaxially with said housing.

8. The switch assembly of claim 7, wherein said actuator is disposed for movement coaxially with said housing.

9. An illuminated push-button switch assembly comprising: a tubular housing, a base member closing said housing at one end thereof, electric lamp means carried by said base member and disposed within said housing, said base member including a pair of flexible resilient switch-mounting arms depending therefrom outwardly of said tubular housing and an opening through said base member between said mounting arms, electric switch means carried by said base member between said mounting arms and having switch contacts extending upwardly through said opening and into said housing, an actuator disposed for reciprocating movement within said housing longitudinally thereof between a normal rest position and an actuating position, said actuator having a light-transmitting portion closing said housing at the other end thereof, said actuator having a cam surface disposed within said housing for engagement with and closure of said switch contacts in response to movement of said actuator from the rest position to the actuating position thereof, and bias means resiliently urging said actuator to the normal rest position thereof.

10. The switch assembly of claim 9, wherein each of said switch mounting arms has a cam surface at the distal end thereof, said switch means being engageable with said cam surfaces resiliently to deflect said switch mounting arms apart to accommodate said switch means therebetween.

* * * * *

UNITED STATES PATENT AND TRADEMARK OFFICE

CERTIFICATE OF CORRECTION

PATENT NO. : 4,419,555

DATED : December 6, 1983

INVENTOR(S) : Syng N. Kim

It is certified that error appears in the above—identified patent and that said Letters Patent is hereby corrected as shown below:

[73] Assignee is incorrectly identified "Wilco Corporation" should read --Wico Corporation--.

Signed and Sealed this

Second Day of October 1984

[SEAL]

*Attest:*

GERALD J. MOSSINGHOFF

*Attesting Officer*

*Commissioner of Patents and Trademarks*